United States Patent [19]

Chen et al.

[11] Patent Number: 5,027,043

[45] Date of Patent: Jun. 25, 1991

[54] ELECTRON GUN SYSTEM WITH DYNAMIC CONVERGENCE CONTROL

[75] Inventors: Hsing-Yao Chen, Barrington; Eugene A. Babicz, Evanston; Richard M. Gorski, Arlington Heights, all of Ill.

[73] Assignee: Zenith Electronics Corporation, Glenview, Ill.

[21] Appl. No.: 521,505

[22] Filed: May 10, 1990

Related U.S. Application Data

[63] Continuation-in-part of Ser. No. 392,630, Aug. 11, 1989.

[51] Int. Cl.[5] ..... H01J 29/70; H01J 29/76

[52] U.S. Cl. ..... 315/368; 313/412

[58] Field of Search ..... 315/368, 382, 15; 313/414, 412, 449

[56] References Cited

U.S. PATENT DOCUMENTS

| | | | |
|---|---|---|---|
| 4,388,553 | 6/1983 | Chen | 313/449 |
| 4,701,677 | 10/1987 | Ashizaki et al. | 315/382 |
| 4,712,043 | 12/1987 | Takenaka et al. | 315/15 |
| 4,814,670 | 3/1989 | Suzuki et al. | 315/15 |
| 4,886,999 | 12/1989 | Yamane et al. | 315/382 |

*Primary Examiner*—Theodore M. Blum

[57] ABSTRACT

For use particularly in a color cathode ray tube electron gun, means for diverting an electron beam from a straight line path. The beam diverting means has general utility, but is disclosed as part of a quadrupole lens for correcting astigmatism introduced by an associated self-converging yoke. The beam bending feature in the dynamic quadrupole compensates for convergence errors undesirably introduced by the dynamic focus voltage.

54 Claims, 7 Drawing Sheets

NEGATIVE ASTIGMATISM CORRECTION

POSITIVE ASTIGMATISM CORRECTION

BIPOTENTIAL TYPE ML DESIGN

EINZEL TYPE ML DESIGN

QPF TYPE ML DESIGN

BU TYPE ML DESIGN

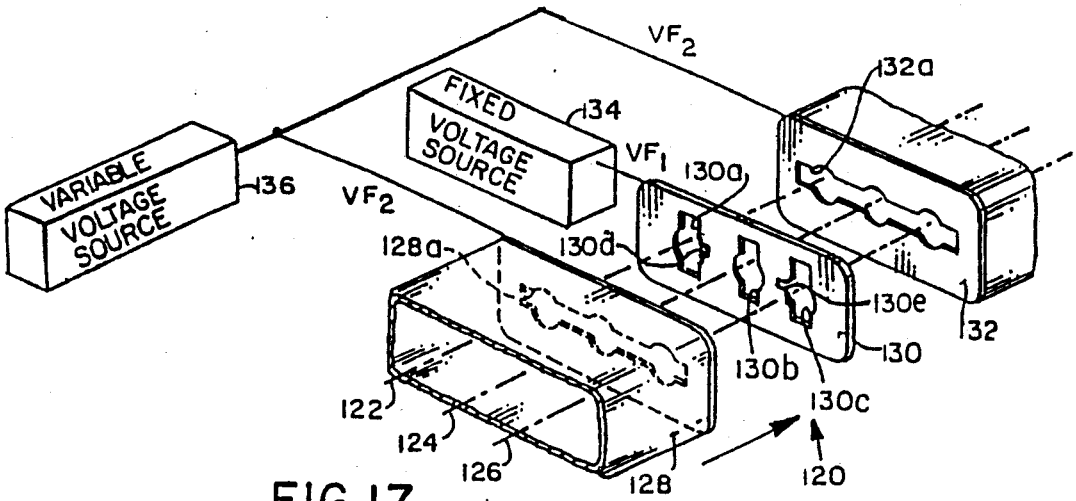
FIG.17
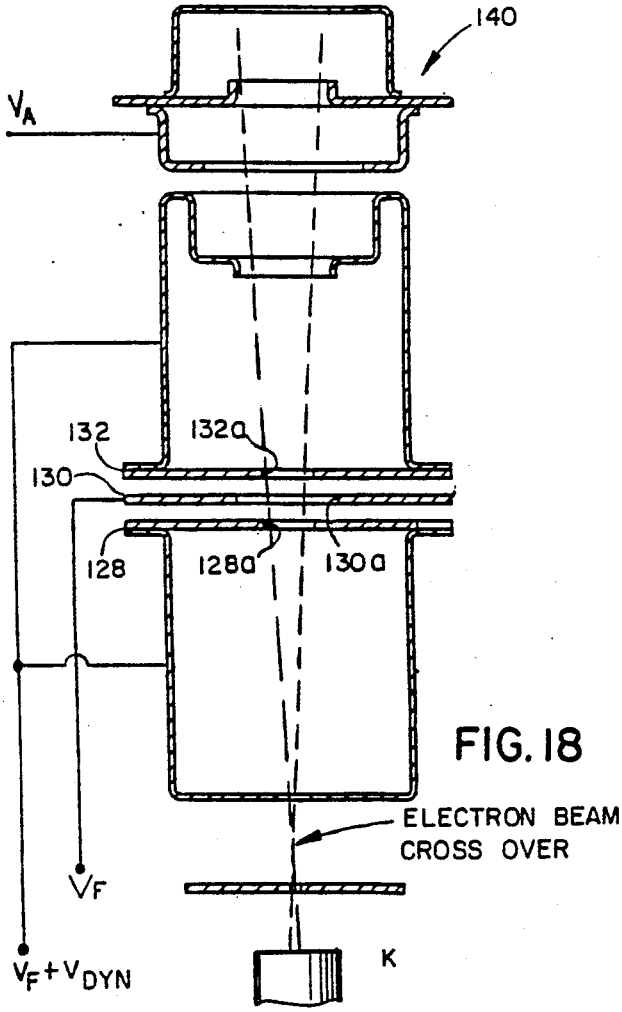
FIG. 18
FIG. 20
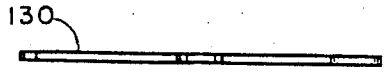
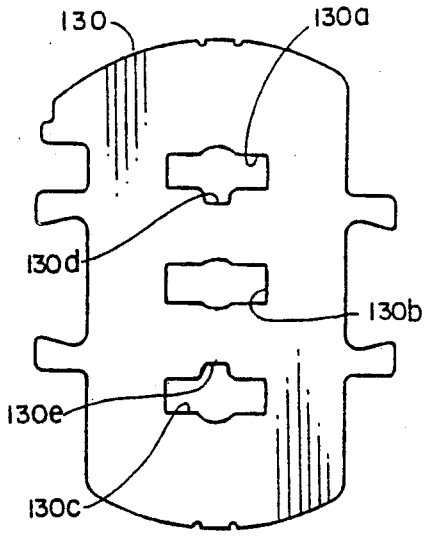
FIG.19

ELECTRON GUN SYSTEM WITH DYNAMIC CONVERGENCE CONTROL

CROSS-REFERENCE TO RELATED APPLICATIONS

This application is a continuation-in-part of an application Ser. No. 392,630, filed Aug. 11, 1989. It is related to but in no way dependent upon co-pending application Ser. No. 579,128 filed Sept. 6, 1990.

BACKGROUND OF THE INVENTION

This invention relates generally to color cathode ray tubes (CRTs) and is particularly directed to the control of multiple electron beams incident upon the faceplate of a color CRT.

Most color CRTs employ an inline electron gun arrangement for directing a plurality of electron beams on the phosphorescing inner screen of its glass faceplate. The inline electron gun approach offers various advantages over earlier "delta" electron gun arrangements particularly in simplifying the electron beam positioning control system as well as essentially eliminating the tendency of the electron beams to drift. However, inline color CRT's employ a self-converging deflection yoke which applies a nonuniform magnetic field to the electron beams, resulting in an undesirable astigmatism in and defocusing of the electron beam spot displayed on the CRT's faceplate. In order to achieve three electron beam convergence at the screen edges and corners, the self-converging yoke applies a dynamic quadrupole magnetic field to the beams which over-focuses the beams in the vertical direction and under-focus them in the horizontal direction. This is an inherent operating characteristic of the inline yoke design.

One approach to eliminate this astigmatism and deflection defocus employs a quadrupole lens with the CRT's focusing electrode which is oriented 90° from the self-converging yoke's quadrupole field. A dynamic voltage, synchronized with electron beam deflection, is applied to the quadrupole lens to compensate for the astigmatism caused by the deflection system. This dynamic voltage also allows for dynamic focusing of the electron beams over the entire CRT screen. The astigmatism of the electron beam caused by the quadrupole lens tends to offset the astigmatism caused by the color CRT's self-converging deflection yoke and generally improves the performance of the CRT.

An article entitled "Progressive-Scanned 33-in. 110° Flat-Square Color CRT" by Suzuki et al published in SID 87 Digest, at page 166, discloses a dynamic astigmatism and focus (DAF) gun wherein spot astigmatism and deflection defocusing is simultaneously corrected using a single dynamic voltage. The electron gun employs a quadrupole lens to which the dynamic voltage is applied and which includes a plurality of generally vertically elongated apertures in a first section of a focusing electrode and a second pair of aligned, generally horizontally oriented elongated apertures in a second section of the focusing electrode. Each electron beam first transits a vertically aligned aperture, followed by passage through a generally horizontally aligned aperture in the single quadrupole lens for applying astigmatism correction to the electron beam.

An article entitled "Quadrupole Lens For Dynamic Focus and Astigmatism Control in an Elliptical Aperture Lens Gun" by Shirai et al, also published in SID 87 Digest, at page 162, discloses a quadrupole lens arrangement comprised of three closely spaced electrodes, where the center electrode is provided with a plurality of keyhole apertures and the outer electrodes are provided with a plurality of square recesses each with a circular aperture in alignment with each of the respective electron beams. A dynamic voltage $V_d$ is applied to the first and third electrodes so as to form a quadrupole field to compensate for the astigmatism caused by the self converging yoke deflection system. Although this allows for a reduction in the dynamic voltage applied to the quadrupole, this voltage still exceeds 1 KV in this approach. While these two articles describe improved approaches for beam focusing and astigmatism compensation, they too suffer from performance limitations particularly in the case of those CRTs having a flat faceplate and foil tension shadow mask, where the flat geometry imposes substantially greater challenges than those encountered with a curved faceplate.

An electron gun employing a quadrupole lens to which a dynamic voltage is applied generally also includes a Beam Forming Region (BFR) refraction lens design intended to correct for the lack of dynamic convergence of the red and blue outer electron beams. The horizontal beam landing locations of the red and blue beams in color CRTs having an inline electron gun arrangement change with variations in the focus voltage applied to the electron gun. While the dynamic quadrupole lens compensates for astigmatism caused by the self-converging electron beam deflection yoke, prior art quadrupole lens arrangements do not address the lack of horizontal convergence of the two outer electron beams.

In a more general sense, this invention addresses the problem of how to electrically converge off-axis beams in a three-beam color cathode ray tube, particularly a color cathode ray tube of the type having an in-line gun.

There exists a number of techniques in the prior art for electrically converging off-axis electron beams in a color cathode ray tube. One technique offsets the axes of apertures in facing electrodes. Offsetting the axes of the cooperating apertures creates an asymmetrical field which bends an electron beam in a direction dependent upon the asymmetry and strength of the field. Examples of electron guns having such offset-aperture-type beam bending are U.S. Pat. Nos. 3,772,554; 4,771,216 and 4,058,753.

A second approach is to use coaxial apertures, but angle the gap between the facing electrodes to produce the necessary asymmetrical field. Examples of electron guns having such "angled gap" technique for producing the necessary asymmetrical field are disclosed in U.S. Pat. Nos. 4,771,216 and 4,058,753.

A third approach is to create the asymmetrical field for the off-axis beam or beams by creating a wedge-shaped gap between the addressing electrodes. Examples of this third approach for electrically converging off-axis beams are disclosed in U.S. Pat. Nos. 3,772,554 and 4,058,753.

Each of these three approaches suffers from difficulties in mandrelling the electrodes during assembly. One aspect of the present invention is to provide improved means in an electron gun for refracting or bending an electron beam, useful for converging off-axis beams in a color CRT gun.

As discussed above, certain modern high performance electron guns have a dynamic quadrupole lens to compensate for beam astigmatism introduced by an associated self-converging yoke. Incorporation of such dynamic quadrupole astigmatism correctors in electron guns of the type having a common focusing field for all three beams introduces convergence errors due to the converging effect produced by such common lens on the off-axis beam. It is an object of this invention to provide an electron gun for a color CRT which corrects for astigmatism introduced by a self-converging yoke without introducing such convergence errors.

In a general sense, this invention concerns improved quadrupolar lenses independent of their application or particular implementation, and more particularly concerns a way to bend an electron beam passing through a quadrupolar lens field. Dynamic control of beam angle as a function of potentials applied to the quadrupolar lens is achievable using the present invention.

OTHER OBJECTS OF THE INVENTION

It is yet another object of the present invention to dynamically compensate for astigmatism and beam focusing errors in an inline, multi-beam color CRT without introduction of convergence errors.

Yet another object of the present invention is to provide a quadrupole lens adapted for use in virtually any of the more common inline color CRTs.

A further object of the present invention is to provide a dynamic quadrupole lens having a plurality of spaced, multi-apertured charged electrodes for use in an inline color CRT which affords precise control of electron beam convergence/divergence.

A still further object of the present invention is to provide an improved electron gun for a color CRT, particularly a color CRT having a planar tension mask and a flat faceplate.

Another object of the present invention is to compensate for the non-uniform magnetic field of a self-converging deflection yoke in a color CRT by dynamically controlling horizontal and vertical divergence/convergence of the CRT electron beams.

A further object of the present invention is to provide improved control over electron beam convergence and divergence in a quadrupole electron beam lens for an inline color CRT.

A still further object of the present invention is to allow for a reduction in the dynamic focusing voltage provided to a quadrupole electron beam focusing lens for a color CRT and minimize problems involving additional high voltage application through a CRT neck pin.

Another object of the present invention is to correct for outer electron beam (typically the red and blue beams) dynamic misconvergence in inline color CRTs having dynamic astigmatism compensation.

BRIEF DESCRIPTION OF THE DRAWINGS

The appended claims set forth those novel features which characterize the invention. However, the invention itself, as well as further objects and advantages thereof, will best be understood by reference to the following detailed description of a preferred embodiment taken in conjunction with the accompanying drawings, where like reference characters identify like elements throughout the various figures, in which:

FIG. 17 is a perspective view of an electron beam misconvergence correction arrangement in accordance with the present invention as employed in a dynamic quadrupole lens for an inline color CRT;

FIG. 18 is a lengthwise sectional view of an electron beam misconvergence correction arrangement as shown in FIG. 17;

FIG. 19 is a plan view of an offset keyhole electrode design for use in an inline multi-electron beam focusing arrangement in an electron gun in accordance with the present invention;

FIG. 20 is an end-on view of the focusing electrode of FIG. 19;

DETAILED DESCRIPTION OF THE PREFERRED EMBODIMENTS

Figure 1:
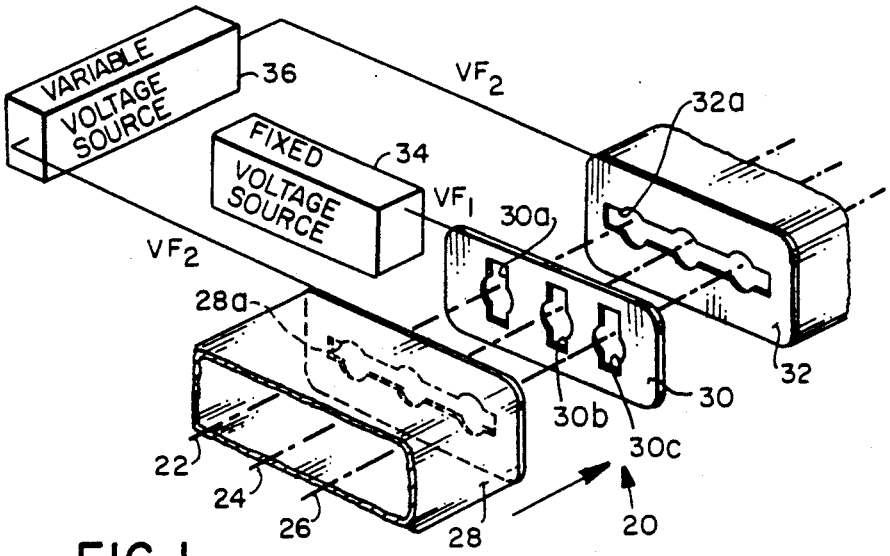
FIG. 1 is a perspective view of a dynamic quadrupole lens for an inline color CRT in accordance with the principles of the present invention.

Referring to FIG. 1, there is shown a perspective view of a dynamic quadrupole lens 20 for use in an inline electron gun in a color CRT. The manner in which the dynamic quadrupole lens of the present invention may be integrated into various existing electron gun arrangements is illustrated in FIGS. 13*a* and 13*b* through 16*a* and 16*b*, and is described in detail below. Various alternative embodiments of the dynamic quadrupole lens of the present invention are illustrated in FIGS. 10 through 16 and are discussed below. Details of the embodiment of the dynamic quadrupole lens 20 illustrated in FIG. 1 are discussed in the following paragraphs, with the principles of the present invention covered in this discussion applicable to each of the various embodiments illustrated in FIGS. 6 through 12. The present invention may be used to correct for astigmatism in CRTs having electron guns with a focusing field common to all three beams such as the Combined Optimum Tube and Yoke (COTY) CRTs, as well as non-COTY CRTs as described below. A COTY-type main lens is used in an inline electron gun and allows the three electron guns to have a larger vertical lens while sharing the horizontal open space in the main lens for improved spot size. The terms "electrode", "grid" and "plate" are used interchangeably in the following discussion.

The dynamic quadrupole lens 20 includes first, second and third electrodes 28, 30 and 32 arranged in mutual alignment. The first electrode 28 includes an elongated aperture 28*a* extending a substantial portion of the length of the electrode. Disposed along the length of the aperture 28*a* in a spaced manner are three enlarged portions of the aperture.

The second electrode 30 includes three keyhole-shaped apertures 30*a*, 30*b* and 30*c* arranged in a spaced manner along the length of the electrode. As in the case of the first electrode 28, the third electrode 32 includes an elongated aperture 32*a* extending along a substantial portion of the length thereof and including three spaced enlarged portions. Each of the aforementioned keyhole-shaped apertures 30*a*, 30*b* and 30*c* has a longitudinal axis which is aligned generally vertically as shown in FIG. 1, or generally transverse to the longitudinal axes of the apertures in the first and third electrodes 28 and 32. With the first, second and third electrodes 28, 30 and 32 arranged generally parallel and in linear alignment, the respective apertures of the electrodes are adapted to allow the transit of three electron beams 22, 24 and 26, each shown in the figure as a dashed line.

The second electrode 30 is coupled to a constant voltage source 34 and is charged to a fixed potential $VF_1$. The first and third electrodes 28, 32 are coupled to a variable voltage source 36 for applying a dynamic voltage $VF_2$ to these electrodes. The terms "voltage" and "potential" are used interchangeably in the following discussion. The present invention is described in detail in the following paragraphs with the dynamic and static voltages applied as indicated, although the principles of this invention also encompass applying a dynamic voltage to the second intermediate electrode 30 while maintaining the first and third electrodes 28, 32 at a fixed voltage.

Figure 2:
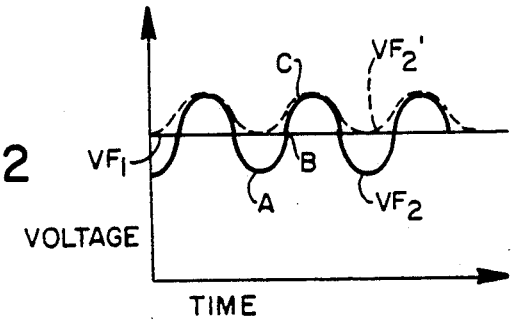
FIG. 2 is a graphic representation of the variation over time of the dynamic voltage applied to the quadrupole lens of the present invention.
Figure 3:
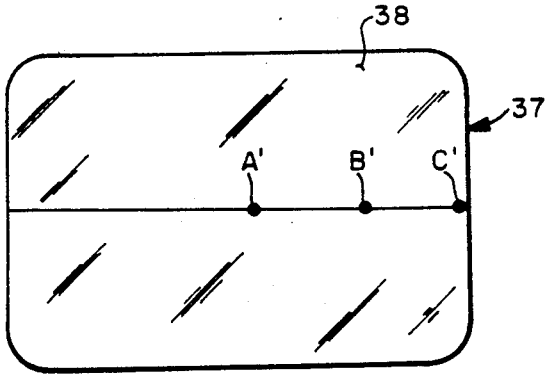
FIG. 3 is a simplified planar view of a phosphor screen on the inner surface of a CRT glass faceplate illustrating various deflection positions of the electron beams thereon.

Referring to FIG. 2, there is shown a graphic representation of the relative voltages at which the second electrode 30 and the first and third electrodes 28, 32 are maintained over time. As shown in FIG. 2, the $VF_1$ voltage is maintained at a constant value, while the $VF_2$ voltage varies in a periodic manner with electron beam sweep. The manner in which the $VF_2$ dynamic voltage varies with electron beam sweep can be explained with reference to FIG. 3 which is a simplified planar view of a CRT faceplate 37 having a phosphorescing screen 38 on the inner surface thereof. The dynamic focusing voltage $VF_2$ applied to the first and third electrodes 28, 32 varies in a periodic manner between a minimum value at point A and a maximum value at point C as shown in FIG. 2. The minimum value at point A corresponds to the electron beams positioned along a vertical centerline of the CRT screen 38 such as shown at point A′ as the electron beams are deflected horizontally across the screen. As the electron beams are further deflected toward the right in FIG. 3 in the vicinity of point B, the dynamic voltage $VF_2$ increases to the value of the fixed focus voltage $VF_1$ as shown at point B in FIG. 2. Further deflection of the electron beams toward the right edge of the CRT screen 38 at point C′ occurs as the dynamic focus voltage $VF_2$ increases to its maximum value at point C in FIG. 3 which is greater than $VF_1$. The dynamic voltage $VF_2$ then decreases to the value of the fixed focus voltage $VF_1$ as the electron beams are deflected leftward in FIG. 3 toward point B′ which is intermediate the center and lateral edge locations on the CRT screen 38. The dynamic voltage $VF_2$ varies relative to the fixed voltage $VF_1$ in a similar manner when the electron beams are deflected to the left of point A′ in FIG. 3 to cover the other half of the CRT screen. In some color CRTs currently in use, such as those of the COTY type, the dynamic focus voltage is varied in a periodic manner but does not go below the fixed focus voltage $VF_1$. This type of dynamic focus voltage is labeled $VF_2'$ in FIG. 2 and is shown in dotted line form therein. The dynamic focus voltage is applied to the first and third electrodes 28, 32 synchronously with the deflection yoke current to change the quadrupole fields applied to the electron beam so as to either converge or diverge the electron beams, depending upon their position on the CRT screen, in correcting for deflection yoke-produced astigmatism and beam defocusing effects as described below.

Figure 4A:
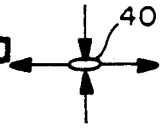
FIGS. 4*a* and 4*b* are sectional views of an electron beam respectively illustrating vertical convergence/horizontal divergence (negative astigmatism effect) and vertical divergence/horizontal convergence (positive astigmatism effect) effected by the dynamic quadrupole lens of the present invention.
Figure 4B:
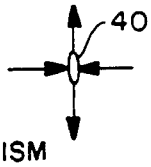

Referring to FIGS. 4*a* and 4*b*, there is shown the manner in which the spot of an electron beam 40 may be controlled by the electrostatic field of a quadrupole lens. The arrows in FIGS. 4*a* and 4*b* indicate the direction of the forces exerted upon an electron beam by the electrostatic field. In FIG. 4*a*, the quadrupole lens is horizontally diverging and vertically converging causing a negative astigmatism of the electron beam 40. This negative astigmatism corrects for the positive astigmatism of the beam introduced by a COTY-type main lens. Negative astigmatism correction is introduced when the beam is positioned in the vicinity of the vertical center of the CRT screen in a COTY-type main lens. In FIG. 4*b*, the quadrupole lens is vertically diverging and horizontally converging for introducing a positive astigmatism correction in the electron beam. Positive astigmatism correction compensates for the negative astigmatism of the electron beam spot caused by the self-converging magnetic deflection yoke as the electron beam is deflected adjacent to a lateral edge of the CRT's screen. Positive and negative astigmatism correction is applied to the electron beams in a COTY type of CRT. In a non-COTY type of CRT, only positive astigmatism is applied in the electron beams. The manner in which the present invention compensates for astigmatism in both types of CRTs is discussed in detail below.

Operation of the dynamic quadrupole lens 20 for an inline color CRT as shown in FIG. 1 will now be described with reference to Table I. Table I briefly summarizes the effect of the electrostatic field of the dynamic quadrupole lens 20 applied to an electron beam directed through the lens. The electrostatic force applied to the electrons in an electron beam by the electrostatic field of the dynamic quadrupole lens is shown in FIG. 5.

Figure 5:
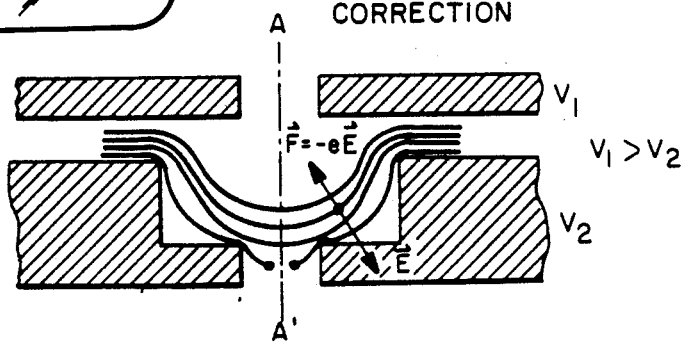
FIG. 5 is a simplified sectional view illustrating the electrostatic potential lines and electrostatic force applied to an electron in the space between two charged electrodes.

Referring to FIG. 5, there is shown a simplified illustration of the manner in which an electrostatic field, represented by the field vector $\vec{E}$, applies a force, represented by the force vector $\vec{F}$, to an electron. An electrostatic field is formed between two charged electrodes, with the upper electrode charged to a voltage of $V_1$ and the lower electrode charged to a voltage of $V_2$, where $V_1$ is greater than $V_2$. The electrostatic field vector $\vec{E}$ is directed toward the lower electrode, while the force vector $\vec{F}$ is directed toward the upper electrode because of the electron's negative charge. FIG. 5 provides a simplified illustration of the electrostatic force applied to an electron, or an electron beam, directed through apertures in adjacent charged electrodes which are maintained at different voltages. It can be seen that the relative width of the two apertures in the electrodes as well as the relative polarity of the two electrodes determines whether the electron beam is directed away from the A—A' axis (divergence), or toward the A—A' axis (convergence).

electron beam 40 is shown in FIG. 4*b* and represents a positive astigmatism correction which compensates for the negative astigmatism introduced in the electron beam by the CRT's self-converging magnetic deflection yoke.

When the electron beams are positioned between the center and a lateral edge of the CRT screen, all three electrodes are at the same voltage and the dynamic quadrupole lens does not introduce either an astigmatism or a focus correction factor in the electron beams. In non-COTY CRTs, the three electrodes are also maintained at the same voltage when the electron beams are positioned on a vertical center portion of the CRT screen as shown graphically in FIG. 2 for the dynamic focus voltage $VF_2'$. In this case, because all three electrodes are again maintained at the same voltage, the dynamic quadrupole lens does not introduce a correction factor in the electron beams to compensate for deflection yoke astigmatism and defocusing effects. In COTY-type CRTs, the dynamic focusing voltage $VF_2$ applied to the first and third electrodes 28, 30 is less than the fixed voltage $VF_1$ of the second electrode 30 in the vicinity of the center of the CRT screen. With the polarity of the electrodes changed, the first and third electrodes 28, 32 introduce a vertical convergence in the electron beams as shown in Table I. The second electrod 30, now at a higher voltage than the other two electrodes, introduces a horizontal divergence by virtue of its generally vertically aligned apertures. The vertical convergence effected by the first and third electrodes 28, 32 and the horizontal divergence caused by the second electrode 30 introduces a negative astigmatism correction in the electron beams as shown in FIG. 4*a*. The negative astigmatism correction compensates for the positive astigmatism effects of a COTY-type main lens on the electron beams in the center of the

TABLE I

| SLOT LOCATION | MAJOR AXIS OF SLOT | FORCE DIRECTION ON THE E-BEAM | OPTICAL EFFECT ON THE E-BEAM AFTER CROSS OVER | COMMENTS |
|---|---|---|---|---|
| HIGHER VOLTAGE SIDE | VERTICAL (Y-DIRECTION) | X - AWAY FROM AXIS<br>Y - NO EFFECT | HORIZ. DIV. | (A) FIELD VECTOR "E" IS IN DIRECTION FROM HIGH VOLTAGE SIDE TO LOW VOLTAGE SIDE (EQUIPOTENTIAL LINES) |
| | HORIZ. (X-DIRECTION) | X - NO EFFECT<br>Y - AWAY FROM AXIS | VERT. DIV. | (B) FORCE VECTOR "F" ON ELECTRON IS EQUAL TO $-e$ E |
| LOWER VOLTAGE SIDE | VERT. (Y-DIRECTION) | X - TOWARD AXIS<br>Y - NO EFFECT | HORIZ. CONV. | |
| | HORIZ. (X-DIRECTION) | X - NO EFFECT<br>Y - TOWARD AXIS | VERT. CONV. | |

With reference to FIG. 1 in combination with Table I, the horizontal slots 28*a*, 32*a* in the first and third electrodes 28, 32 cause vertical divergence of the electron beam when they are maintained at a voltage greater than the second electrode 30 such as when the electron beams are positioned adjacent to a lateral edge of the CRT screen. With the second electrode 30 maintained at a lower voltage $VF_1$ than the other two electrodes when the electron beams are located adjacent the CRT screen's lateral edge, as shown at point C in FIG. 2, the vertically aligned apertures of the second electrode effect a horizontal convergence of the electron beams which reinforces the vertical divergence correction of the other two electrodes. This combination of vertical divergence and horizontal convergence of an CRT screen.

Although the first and third electrodes 28, 32 are each shown with a single elongated, generally horizontally aligned aperture, the present invention also contemplates providing each of these electrodes with a plurality of spaced, aligned apertures each having a horizontally oriented longitudinal axis and adapted to pass a respective one of the electron beams. In addition, while the operation of the present invention has thus far been described with the dynamic quadrupole lens positioned after electron beam cross over, or between cross over and the CRT screen, the dynamic quadrupole lens may also be positioned before beam cross over, or between the electron beam source and cross over. The effect of the dynamic quadrupole lens on the electron beams is reversed in these two arrangements as shown in Table I.

Referring to FIGS. 6 through 12, there are shown various alternative embodiments of the dynamic quadrupole lens of the present invention. In the dynamic quadrupole lens 50 of FIG. 6, the first and third electrodes 51 and 53 include respective elongated, generally rectangular apertures 51*a* and 53*a* through which the three electron beams are directed. The second electrode 52 includes a plurality of spaced, generally rectangular shaped apertures 52*a*, 52*b* and 52*c*. Each of the rectangular apertures 52*a*, 52*b* and 52*c* is aligned lengthwise in a generally vertical direction.

Figure 6:
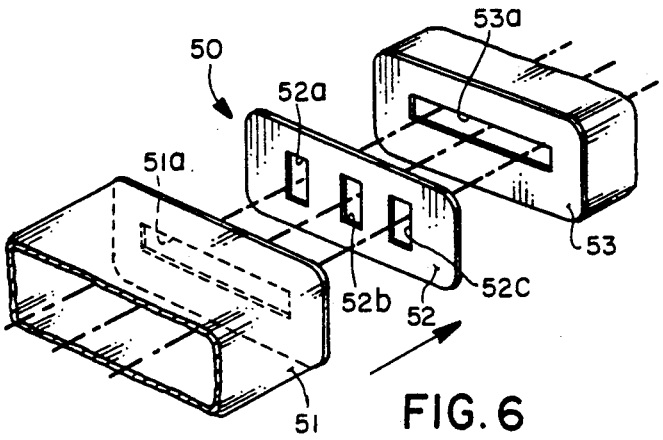
FIGS. 6 through 12 illustrate additional embodiments of a dynamic quadrupole lens for focusing a plurality of electron beams in an inline color CRT in accordance with the principles of the present invention.
Figure 8:
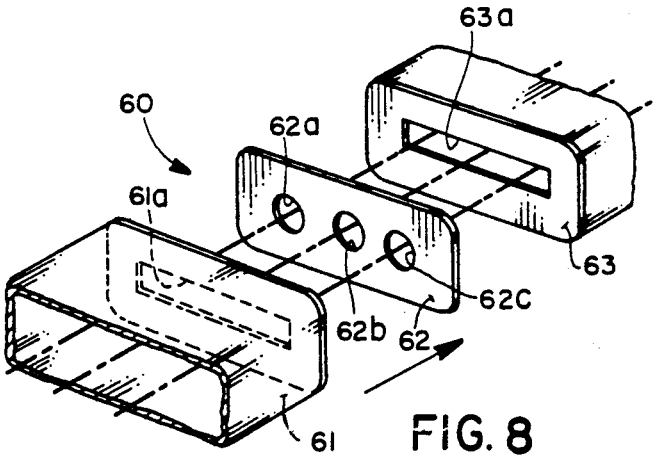

The dynamic quadrupole lens 60 of FIG. 8 is similar to that of FIG. 6 in that the first and third electrodes 61 and 63 each include a respective rectangular, horizontally oriented aperture 61*a* and 63*a*. However, in the dynamic quadrupole lens 60 of FIG. 8, the second electrode 62 includes three circular apertures 62*a*, 62*b* and 62*c*. Where circular apertures are employed, the second electrode 62 will not function as a quadrupole lens element, although the first and third electrodes 61 and 63 will continue to so operate. The three apertures 62*a*, 62*b* and 62*c* may also be elliptically shaped with their major axes oriented generally vertically, in which case the second electrode 62 will function as a quadrupole lens element to converge or diverge the electron beams, as the case may be.

Figure 7:
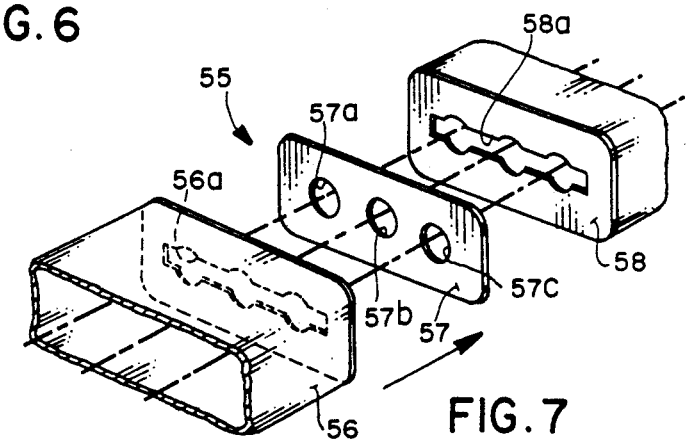
Figure 9:
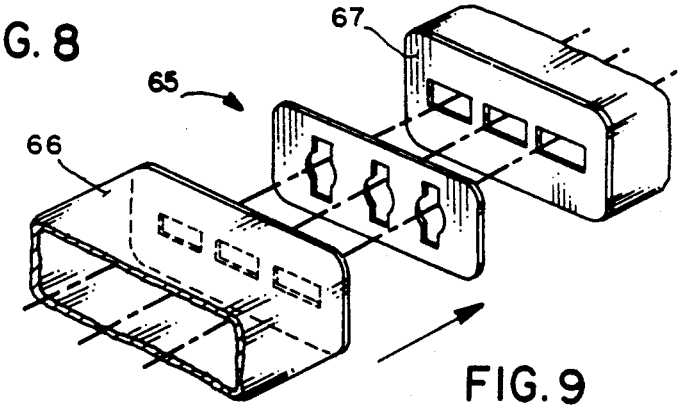
Figure 10:
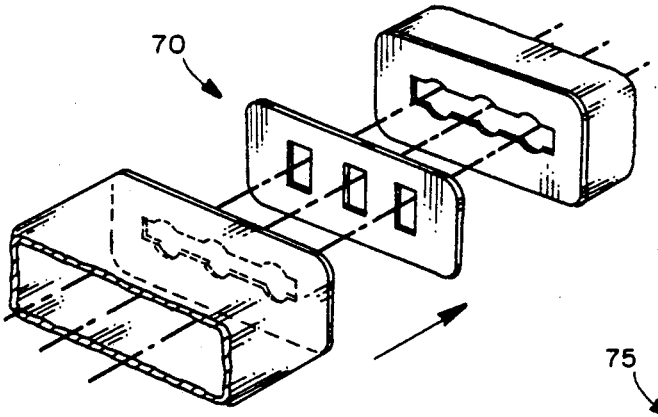

The dynamic quadrupole lens 55 of FIG. 7 is a combination of the lenses shown in FIGS. 1 and 8 in that the second electrode 57 includes three circular, or elliptically shaped, apertures 57*a*, 57*b* and 57*c*, while the first and third electrodes 56 and 58 each include respective elongated, horizontally oriented apertures 56*a* and 58*a*. Each of the apertures 56*a* and 58*a* includes a plurality of spaced enlarged portions through which a respective one of the electron beams is directed. The dynamic quadrupole lenses 65 and 70 respectively shown in FIGS. 9 and 10 also include three spaced electrodes in alignment with three electron beams, wherein the electrodes include various combinations of apertures previously described and illustrated. In FIG. 9, the first and third electrodes 66 and 67 are each shown with a plurality of spaced elongated apertures having their longitudinal axes in common alignment with the inline electron beams.

Figure 11:
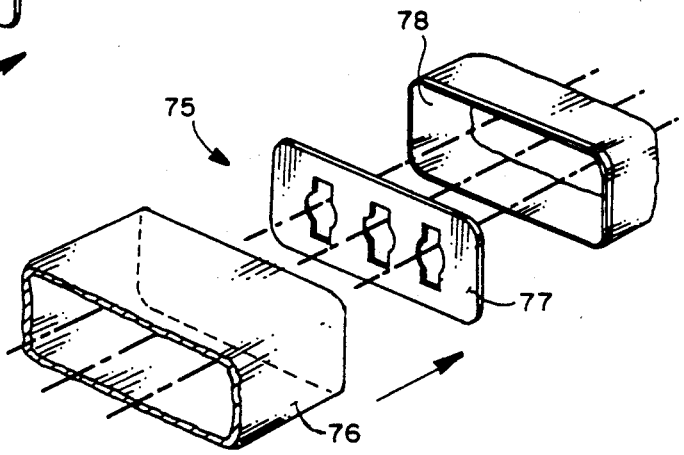
Figure 12:
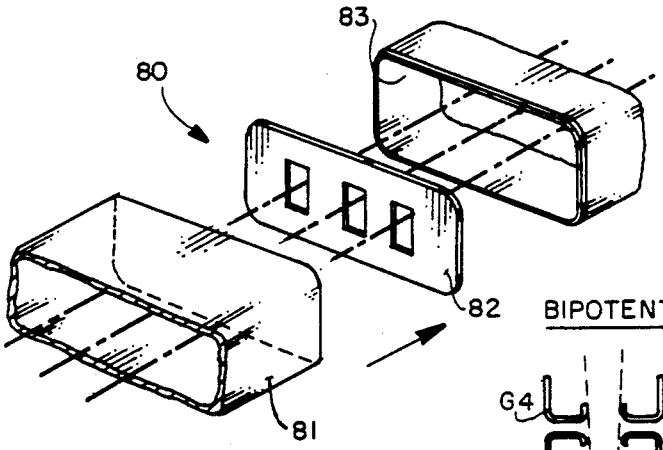

Referring to FIG. 11, there is shown yet another embodiment of a dynamic quadrupole lens 75 in accordance with the principles of the present invention. The dynamic quadrupole lens 75 includes first and third electrodes 76 and 78, which are each in the general form of an open frame through which the electron beams pass, and a second electrode 77 having three spaced, generally vertically oriented apertures through each of which a respective one of the electron beams is directed. The first and third electrodes 76 and 78 do not include an aperture through which electron beams are directed, or may be considered to have an infinitely large aperture disposed within a charged electrode. At any rate, it has been found that it is the dynamic focusing voltage applied to the first and third electrodes 76 and 78 which functions in combination with the charge on the second electrode 77, and the apertures therein, to provide electron beam convergence/divergence control in compensating for electron beam astigmatism and defocusing. The dynamic quadrupole lens 80 of FIG. 12 is similar to that shown in FIG. 11, except that the three apertures in the second electrode 82 are generally rectangular in shape and operate in conjunction with the first and third dynamically charged electrodes 81 and 83.

The dynamic quadrupole lens 75 operates in the following manner. In a COTY-type CRT, the second electrode 77 will be at a higher voltage than the first and third electrodes 76, 78 when the electron beams are positioned near the center of the CRT screen. The second electrode 77 will thus cause a horizontal divergence resulting in a negative astigmatism correction as shown in FIG. 4*a*. The first and third electrodes 76, 78 cause a vertical convergence of the electron beams to further effect negative astigmatism correction. When the electron beams are adjacent to a lateral edge of the CRT screen, the second electrode 77 will be at a lower voltage than the first and third electrodes 76, 78 resulting in horizontal convergence and vertical divergence of the electron beams as shown in Table I and as illustrated in FIG. 4*b* as a positive astigmatism correction. Thus, electron beam astigmatism and defocusing are corrected for by the dynamic quadrupole lenses of FIGS. 11 and 12, although the compensating effects of this electrode arrangement are not as great as in the previously discussed embodiments wherein all three electrodes are provided with apertures.

Figure 13A:
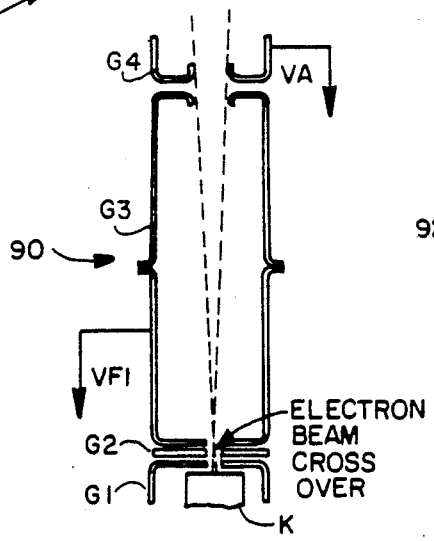
FIGS. 13*a* and 13*b* respectively illustrate sectional views of a prior art bipotential type ML electron focusing lens and the manner in which the dynamic quadrupole lens of the present invention may be incorporated in such a prior art electron beam focusing lens.

Referring to FIG. 13*a*, there is shown a conventional bipotential type main lens (ML) electron gun 90. The bipotential type ML electron gun 90 includes a cathode K which provides electrons to the combination of a control grid electrode G1, a screen grid electrode G2, a first accelerating and focusing electrode G3, and a second accelerating and focusing electrode G4. A focusing voltage $VF_1$ is applied to the first accelerating and focusing electrode G3, and an accelerating voltage $V_A$ as applied to the second accelerating and focusing electrode G4.

Figure 13B:
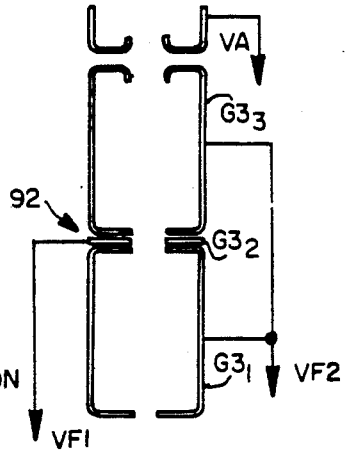

FIG. 13*b* shows the manner in which a dynamic quadrupole lens 92 may be incorporated in a conventional bipotential type ML electron gun. The dynamic quadrupole lens 92 includes adjacent plates of a $G3_1$ electrode and a $G3_3$ electrode to which a dynamic focusing voltage VF2 is applied. The dynamic quadrupole lens 92 further includes a $G3_2$ electrode, or grid, which is maintained at a fixed voltage VF1. The cathode as well as various other control grids which are illustrated in FIG. 13*a* have been omitted from FIG. 13*b*, as well as the remaining figures, for simplicity. Thus, a bipotential type ML electron gun may be converted to an electron gun employing the dynamic quadrupole lens of the present invention by separating its first accelerating and focusing electrode G3 into two components and inserting a third fixed voltage electrode $G3_2$ between the two accelerating and focusing electrode components $G3_3$ and $G3_1$.

Figures 14A, 14B:
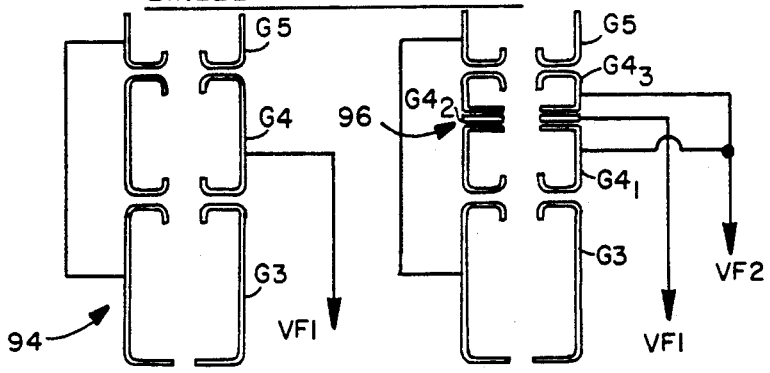
FIGS. 14*a* and 14*b* are sectional views of a prior art Einzel-type ML electron focusing lens and the same focusing lens design incorporating a dynamic quadrupole lens in accordance with the present invention, respectively.

Referring to FIG. 14*a*, there is shown a conventional Einzel-type ML electron gun 94 which includes G3, G4 and G5 accelerating and focusing electrodes.

Referring to FIG. 14*b*, there is shown the manner in which a dynamic quadrupole lens 96 in accordance with the present invention may be incorporated in a conventional Einzel-type ML electron gun. In the electron gun arrangement of FIG. 14*b*, the G4 electrode is divided into two lens components $G4_1$ and $G4_3$, and a third focusing electrode $G4_2$ is inserted between the adjacent charged plates of the $G4_1$ and $G4_3$ electrodes. A fixed focus voltage VF1 is applied to the $G4_2$ electrode, while a dynamic focus voltage VF2 is applied to the $G4_1$ and $G4_3$ electrodes. The dynamic quadrupole lens 96 within the Einzel-type ML electron gun thus includes adjacent charged plates of the $G4_1$ and $G4_3$ accelerating and focusing electrodes in combination with an intermediate $G4_2$ electrode which is maintained at a fixed focus voltage VF1.

Figures 15A, 15B, 15C, 15D:
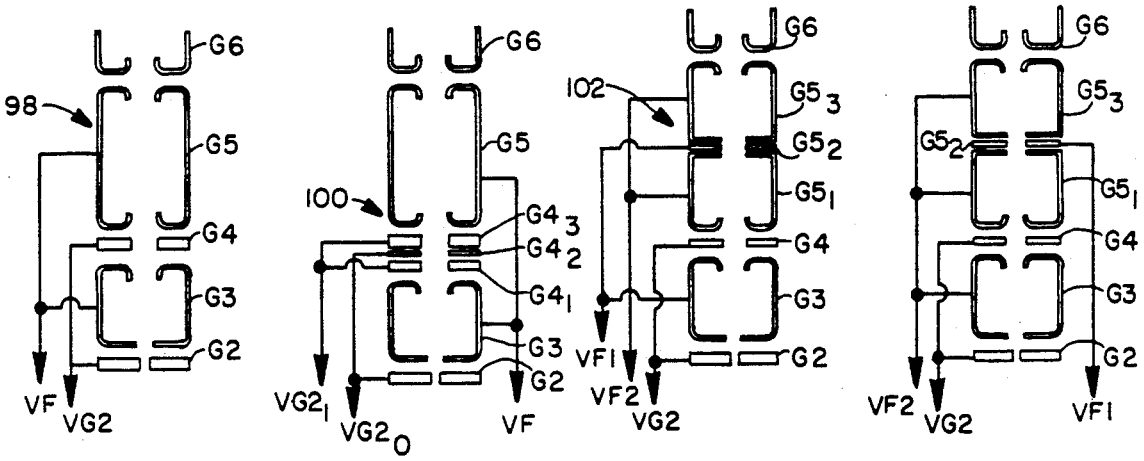
FIGS. 15*a*, 15*b*, 15*c* and 15*d* respectively illustrate sectional views of a prior art QPF-type ML electron focusing lens and three versions of such a QPF-type ML lens incorporating a dynamic quadrupole lens in accordance with the present invention.

Referring to FIG. 15*a*, there is shown a conventional QPF type ML electron gun 98. The QPF type ML electron gun 98 includes G2, G3, G4, G5 and G6 electrodes. A fixed focus voltage VF is applied to the G3 and G5 electrodes.

FIG. 15*b* illustrates the manner in which a dynamic quadrupole lens 100 in accordance with the present invention may be incorporated in the G4 electrode of a QPF type ML electron gun. In the arrangement of FIG. 15*b*, the G4 electrode is comprised of $G4_1$, $G4_2$ and $G4_3$ electrodes. The G2 and $G4_2$ electrodes are maintained at a voltage $VG2_0$, while the $G4_1$ and $G4_3$ electrodes are maintained at a voltage $VG2_1$. The $VG2_0$ voltage is fixed, while the $VG2_1$ voltage varies synchronously with electron beam sweep across the CRT screen.

Referring to FIG. 15*c*, there is shown the manner in which a dynamic quadrupole lens 102 in accordance with the present invention may be incorporated in the G5 electrode of a conventional QPF type ML electron gun. In the arrangement of FIG. 15*c*, the G5 accelerating and focusing electrode of a conventional QPF type ML electron gun has been divided into three control electrodes $G5_1$, $G5_2$ and $G5_3$. A fixed focus voltage VF1 is applied to the G3 and $G5_2$ electrodes, while a dynamic focus voltage VF2 is applied to the $G5_1$ and $G5_3$ electrodes. A VG2 voltage is applied to the G2 and G4 electrodes. The dynamic quadrupole lens 102 is comprised of the $G5_2$ electrode in combination with the adjacent plates of the $G5_1$ and $G5_3$ electrodes. In FIG. 15*d*, the G3 electrode is shown coupled to the VF2 focus voltage rather than the VF1 focus voltage as in FIG. 15*c*. In the arrangement of FIG. 15*d*, two spatially separated quadrupoles each apply an astigmatism correction to the electron beams. A first quadrupole is comprised of the upper plate of the G3 electrode, the lower plate of the $G5_1$ electrode, and the G4 electrode disposed therebetween. A dynamic focus voltage VF2 is provided to the G3, $G5_1$ and $G5_3$ electrodes. The second quadrupole is comprised of the upper plate of the $G5_1$ electrode, the lower plate of the $G5_3$ electrode, and the $G5_2$ electrode disposed therebetween. The $G5_3$ and G6 electrodes form an electron beam focusing region, while the combination of electrodes G2 and G3 provide a convergence correction for the two outer electron beams as the beams are swept across the CRT screen with changes in the electron beam focus voltage. This is commonly referred to as a FRAT (focus refraction alignment test) lens.

Referring to FIG. 16, there is shown a conventional BU type ML electron gun 104. The BU type ML electron gun 104 includes G3, G4, G5 and G6 electrodes. An anode voltage VA is applied to the G4 and G6 electrodes, while a dynamic focus voltage VF is applied to the G3 and G5 electrodes.

Figures 16A, 16B:
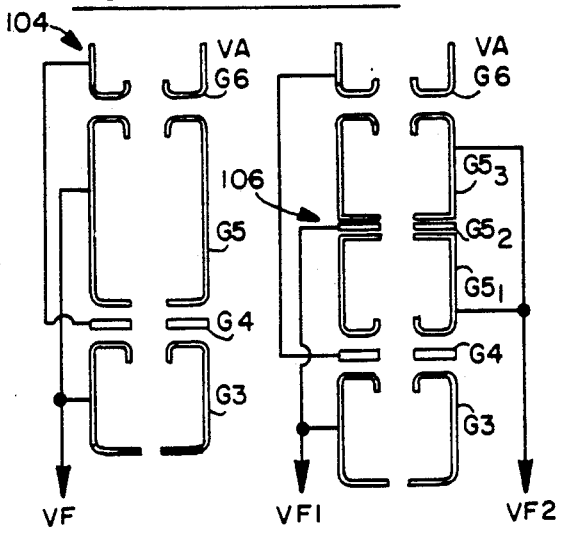
FIGS. 16*a* and 16*b* respectively illustrate sectional views of a prior BU-type ML electron focusing lens and the same type of electron focusing lens incorporating the inventive dynamic quadrupole lens of the present invention.

FIG. 16*b* shows the manner in which a dynamic quadrupole lens 106 in accordance with the present invention may be incorporated in a conventional BU type ML electron gun. The G5 electrode of the prior art BU type ML electron gun is reduced to two electrodes $G5_1$ and $G5_3$, with a third electrode $G5_2$ inserted therebetween. The dynamic quadrupole lens 106 thus is comprised of adjacent plates of the $G5_1$ and $G5_3$ electrodes in combination with the $G5_2$ electrode. A fixed focus voltage VF1 is applied to the G3 and $G5_2$ electrodes, while the anode voltage VA is applied to the G4 and G6 electrodes. A dynamic focusing voltage $VF_2$ is applied to the $G5_1$ and $G5_3$ electrodes in the electron gun.

THE PRESENT INVENTION

As discussed at some length above, in an electron gun of a type having a main focusing lens which is common to all three beams, and which has a dynamic quadrupole astigmatism corrector for correcting the astigmatism introduced by a self-converging yoke, the changing potential applied to the dynamic quadrupole astigmatism corrector changes the strength of the main focusing lens field. In an electron gun of the type having a main focusing lens common to all three beams, changing the strength of the main focusing lens field changes the convergence of the beams. Thus, dynamic astigmatism correction using the afore-discussed dynamic quadrupole undesirably alters the convergence of the beams.

In accordance with an aspect of this invention, means are provided for correcting or reducing such convergence errors. As will be explained, this is accomplished by unbalancing the quadrupolar lens fields through which the off-axis beams pass. The unbalancing is accomplished in a preferred embodiment by the creation of an asymmetrical field component which has a refractive effect on the off-axis beams, causing them to converge or diverge as a function of the strength and degree of asymmetry of the asymmetrical fields applied to the off-axis beams. As will also be explained in more detail hereinafter, in a preferred embodiment the asymmetrical fields are produced by providing an aperture pattern in one or more of the facing electrodes employed to create the quadrupolar lens field for the off-axis beams which is shaped to create an asymmetry in the field affecting the off-axis (outer) beams.

In one embodiment to be described (FIGS. 17–20), a novel electrode has a center opening and two outer openings arranged in-line along an electrode axis orthogonal to the gun axis. The outer openings have profile distortions which are symmetrical about the electrode axis and a vertical axis through the center opening, but asymmetrical about respective vertical axes through the outer beam openings. In one preferred embodiment, the opening profile distortions each take the form of an inwardly or outwardly extending opening enlargement (a notch, for example). In another arrangement (FIG. 22, to be described) the asymmetrical field is produced in an electrode having a horizontal aperture extending across all three beams, the terminal portions of which are vertically larger than the center portions of the horizontal aperture so as to create the aforediscussed opening enlargement and asymmetrical field.

The invention may be employed in unipotential (Einzel) type quadrupolar lenses, or quadrupolar lenses of the bipotential or other type. The profile distortion provided to create the field asymmetry for the off-axis beams may be located in any or all of the electrodes which constitute the quadrupolar lens. If the profile distortion is located in the electrode or electrodes having relatively higher voltage, the profile enlargement extends away from the center beam opening; if located in the electrode or electrodes having lower applied potential, the opening enlargement which creates the asymmetrical field extends inwardly toward the center beam opening.

In a broader context, the invention concerns a quadrupolar lens for an electron gun having the capability of bending a beam passing through the lens, independent of the application or manner of implementing the quadrupolar lens. In this context, the invention concerns the provision of a quadrupolar lens having at least two facing apertured electrodes, one adapted to receive a relatively higher excitation potential and the other a relatively lower excitation potential, the electrodes being constructed and arranged such that a quadrupolar field component is created therebetween for the beam when different excitation potentials are applied to the facing electrodes. The quadrupolar lens includes means for unbalancing the quadrupolar field component such as to cause the beam to be diverted from a straight line path as a function of the different applied potentials. The unbalancing, as described, is preferably by provision of an asymmetrical field component in the quadrupolar lens which, in turn, is preferably created by the provision of an aperture pattern in one or both of the facing electrodes, all as outlined above and as will be described in detail hereinafter.

Such a quadrupole lens with beam bending capability may be employed in electron guns in general, but not limited to the type described above and to be described hereinafter wherein the quadrupole lens provides astigmatism correction to offset astigmatism produced by an associated self-converging yoke.

In still a broader context, this invention provides an improved means for electrically bending or diverting the path of an electron beam, independent of its use in a quadrupolar or any other particular type of lens. In the background of the invention set forth above, mention is made of three types of electron-refractive devices which each create an asymmetrical field in the path of an electron beam to divert it from a straight line path. One employs offset apertures, another an angled electrode gap, and a third a wedge-shaped gap between the operative electrodes. Applicants here provide a fourth way—namely, by the provision of an aperture pattern in one or more of both of the facing electrode(s) which is so shaped relative to the aperture pattern in the facing electrode as to create an asymmetrical pattern in the facing electrode as to create an asymmetrical field influencing the passed electron beams. Thus the beam bender of the present invention may be used in substitution for any of the above three types of beam benders in any application in which they are found, as well as other applications which call for electrical beam divergence. The present invention has the advantage over the aforediscussed three types of beam benders found in the prior art in that it is more easily mandrelled during electron gun assembly than any of those arrangements.

In this most general context, the invention may be thought of as comprising means for generating a beam of electrons, and beam bending means for producing an asymmetrical field in the path of the beam for diverting the beam from a straight line path. The beam bending means comprises at least two facing electrodes adapted to receive different excitation potentials and having coaxial beam-passing openings, at least one of the openings being symmetrical about a first electrode axis, but asymmetrical about an orthogonal second axis to thereby produce the said asymmetrical field.

Such a beam bender may be adapted for dynamic convergence by employing it in the off-axis beams and applying a varying potential to one or both of the operative facing electrodes to cause the strength of the asymmetrical field to vary as a function of the applied voltage. In application to a three beam in-line gun color CRT having dynamic convergence, a variable voltage correlated with the deflection of the beam across the screen may be applied to one or all of the electrodes. The use of a beam bender for dynamic beam convergence, with or independent of a quadrupolar lens, is claimed and described in our co-pending application, Ser. No. 579,128.

A preferred embodiment of the invention is disclosed in FIGS. 17–20.

Referring to FIG. 17, there is shown a perspective view of a dynamic quadrupole lens 120 for use in an inline electron gun in a color CRT incorporating a second electrode 130 in accordance with the present invention. The dynamic quadrupole lens 120 includes first, second and third electrodes 128, 130 and 132 arranged in mutual alignment. The first electrode 128 includes an elongated aperture **128*a* extending a substantial portion of the length of the electrode. Disposed along the length of the aperture 128*a* in a spaced manner are three openings in the form of enlarged portions of the aperture. As in the case of the first electrode 128, the third electrode 132 also includes an elongated aperture 132*a* extending along a substantial portion of the length thereof and including three spaced openings in the form of enlarged portions of the aperture 132*a*. The first and third electrodes 128 and 132 are aligned so that first, second and third electron beams 122, 124 and 126 respectively transit the corresponding enlarged portions of the elongated apertures 128*a* and 132*a* within the first and third electrodes. The first and third electrodes 128, 132 are coupled to a variable voltage source 136** for applying a dynamic voltage $VF_2$ to these electrodes.

The second electrode 130 is disposed intermediate the first and third electrodes 128, 132 and includes three keyhole-shaped apertures **130*a*, 130*b* and 130*c* arranged in a spaced manner along the length of the electrode. Each of the aforementioned keyhole-shaped apertures 130*a*, 130*b* and 130*c* has a longitudinal axis which is aligned generally vertically as shown in FIG. 17, or generally transverse to the longitudinal axes of the apertures in the first and third electrodes 128 and 132. With the first, second and third electrodes 128, 130 and 132 arranged generally parallel in a linear alignment, the respective apertures of the electrodes are adapted to allow the transit of the three electron beams 122, 124 and 126, each shown in the figure as a dashed line. The second electrode 30 is coupled to a constant voltage source 134** and is charged to a fixed potential $VF_1$.

Referring also to FIGS. 19 and 20, additional details of the second electrode 130 which concern an aspect of this invention will now be described. Each of the three keyhole-shaped apertures **130*a*, 130*b* and 130*c* in the second electrode 130 includes an enlarged center portion through which a respective one of the electron beams is directed. As shown in the figures, the two outer keyhole-shaped apertures 130*a* and 130*c* are provided with respective opening profile distortions or opening enlargements in the form of notches 130*d* and 130*e* on inner portions thereof and are in the general form of an offset keyhole. The opening enlargements (here notches) 130*d* and 130*e* in the offset keyhole-shaped apertures 130*a* and 130*c* unbalance the horizontal focusing strength of the two outer offset keyholes to produce an asymmetrical field component having a refraction lens effect, where the strength of the refraction lens on the two outer electron beams is proportional to the dynamic drive voltage $V_{DYN}$ applied to the first and third electrodes 128 and 132. The refraction lens effect of the notched inner portions of the two outer keyhole-shaped apertures 130***a* and 130*c* moves the outer (here red and blue) electron beams inwardly or outwardly along the horizontal direction across the CRT's faceplate to reduce or cancel the dynamic outer beam misconvergence effect caused by the use of a common focusing field for all three beams. The outer electron beams are horizontally displaced either inwardly or outwardly depending upon the voltages on the first and third electrodes 128 and 132 relative to the voltage of the second electrode 130.

Referring to FIG. 18, there is shown a sectional view of the arrangement of FIG. 17 including a quadrupole focusing type main lens (ML) electron gun 140 incorporating the focusing electrode 130 of the present invention. In the arrangement of FIG. 18, the first, second and third electrodes 128, 130 and 132 form a dynamic quadrupole to compensate for electron beam astigmatism and defocusing caused by the electron beam deflection yoke. A fixed focusing voltage $V_{F1}$ is applied to the second electrode 130 while a dynamic focusing voltage $V_{F2}+V_{DYN}$ as applied to the first and third electrodes 128 and 132. A cathode K emits electrons which are controlled by various grids including a screen grid electrode G2. The electrons are then directed to a first accelerating and focusing electrode G3. The G3 electrode is comprised of a G3 lower section, a G3 upper section, and the aforementioned dynamic quadrupole region disposed therebetween. The respective apertures 128*a*, 130*a* and 132*a* in the first, second and third electrodes 128, 130 and 132 are aligned to allow the transit of each of the three electron beams as discussed above and shown in FIG. 17. A second accelerating and focusing electrode G4 is disposed adjacent to the G3 upper portion, with a COTY type main lens (ML) dynamic focus region (or stage) formed by the G3 and G4 electrodes.

While a second electrode 130 having a pair of outer keyhole-shaped apertures 130*a* and 130*c* each with an inner notch is disclosed and illustrated herein as forming a portion of a dynamic quadrupole electron beam focusing lens, as noted above, the opening profile distortion feature of the present invention is not limited to use in a dynamic quadrupole lens and may be used simply by itself in virtually any type of conventional electron gun. Even when not used in a dynamic quadrupole lens, the offset keyhole design of the inventive focusing electrode 130 exerts a refractive lens effect on the off-axis (outer) electron beams, with the strength of the refraction (asymmetrical) lens being proportional to the dynamic focusing voltage applied to the main lens focusing stage, to horizontally displace the outer (here red and blue) beams so as to reduce or cancel the dynamic red/blue misconvergence effect of the multibeam electron gun. When not employed in a quadrupole electron beam focusing lens, the inventive electrode 130 is disposed intermediate the G3 lower and upper electrode portions, with the first and third electrodes 128, 132 absent from such an electron beam focusing arrangement.

Figure 21:
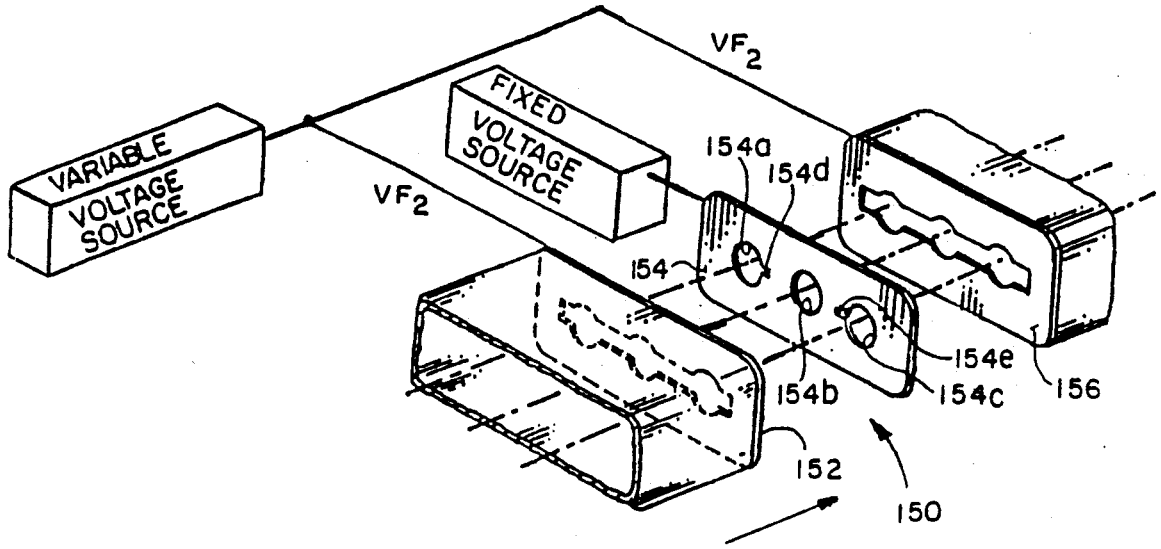
FIG. 21 is a perspective view of an electron beam misconvergence correction arrangement incorporating generally circular, notched outer apertures in a center electrode in accordance with another embodiment of the present invention.

FIG. 21 is a perspective view of another embodiment of an electron beam misconvergence correction arrangement 150 including first, second and third electrodes 152, 154 and 156. The second (middle) electrode 154 includes three generally circular spaced apertures 154*a*, 154*b* and 154*c*. The outer two apertures 154*a* and 154*c* include respective inwardly opening enlargements in the form of directed notches 154*d* and 154*e*. These notches provide an unbalanced horizontal focusing field to produce the refraction lens effect, where the strength of the refraction lens on the two outer electron beams is proportional to the dynamic drive voltage applied to the first and third electrodes 152 and 156. This electrode 160 is introduced for use in a lens arrangement wherein it receives the higher applied potential.

Figure 22:
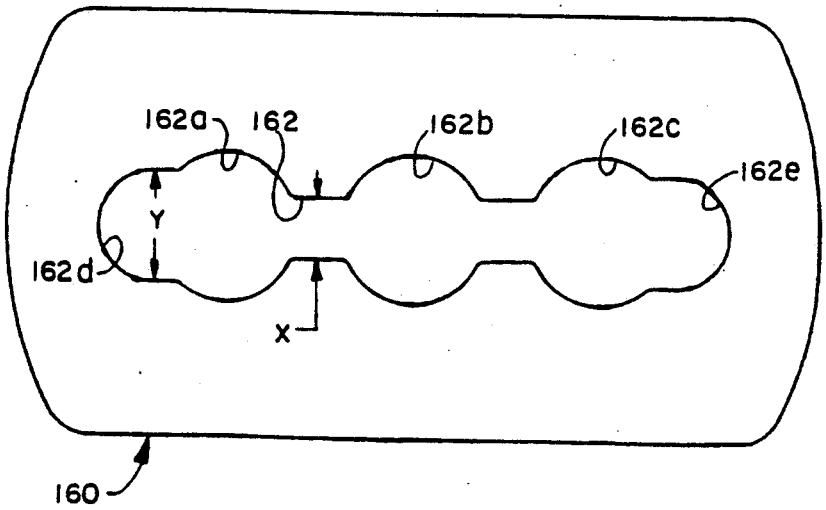
FIG. 22 is a plane view of another embodiment of an electrode in accordance with the present invention, where the electrode has a higher voltage than an adjacent focusing electrode.

Referring to FIG. 22, there is shown a plan view of an electrode 160 in accordance with another embodiment of the present invention. The electrode 160 is adapted for use in a dual quadrupole electron beam focusing arrangement as described above for the first and third electrodes, where the first and third electrodes are maintained at a higher voltage than a second, middle electrode. A dynamic focusing voltage is applied to the electrode 160 which includes an elongated aperture 162 therein. As in previous embodiments, the elongated aperture 162 is provided with a plurality of spaced beam-passing openings in the form of openings (enlarged portions) 162*a*, 162*b* and 162*c* along the length thereof. An electron beam is directed through each of the openings 162*a*, 162*b* and 162*c* along the length of the elongated aperture 162 in the electrode 160. With the electrode 160 maintained at a higher voltage than an adjacent, middle electrode (not shown), the elongated aperture 162 is provided with a pair of extensions 162*e* and 162*d*, each at a respective end of the elongated aperture 162. The end extensions 162*e* and 162*d* of the elongated aperture 162 provide an unbalanced horizontal focusing field effect on the two other electron beams to correct the focus-convergence interaction between the red and blue beams arising from changes in the magnitude of the dynamic focus voltage. The difference between electrode 160 and previously described embodiments is in the width (or height) of the extensions 162*e* and 162*d* relative to the width of the elongated aperture 162. In a preferred embodiment of electrode 160, the extensions 162*e*, 162*d* each have a width of Y=0.115 mil, while the width of aperture 162 is 0.065 mil. The greater widths of the extensions 162*d*, 162*e* on each end of the elongated aperture 162 weakens the electrostatic field exerted on the two outer electron beams allowing for reduced outer electron beam deflection in correcting the focus-convergence interaction arising from changes in the focus voltage.

Figure 23:
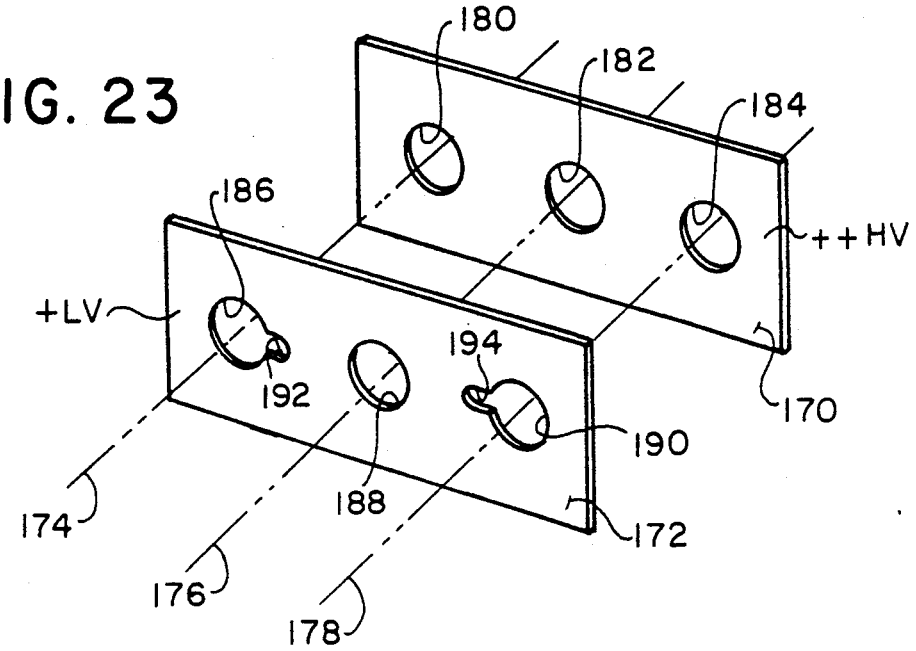
FIG. 23 is a schematic illustration of a focusing lens structure in a three-beam in-line gun wherein the outer electron beams are electrically converged by the present invention.

As suggested above, the present invention can be viewed in a broad context as providing means for electrically refracting or bending an electron beam in various applications in electron guns not limited to the preferred embodiments described above. FIG. 23 is a schematic illustration of the use of a focusing lens structure in a three-beam in-line gun in which the outer beams are electrically converged by use of the present invention. Specifically, FIG. 23 illustrates a pair of facing electrodes 170, 172 for converging three electron beams 174, 176 and 178. Electrode 170 has apertures 180, 182 and 184 which cooperate with apertures 186, 188 and 190 in adjacent electrode 172. Electrode 172 is adapted to receive a relatively lower potential and electrode 170 is adapted to receive a relatively higher potential.

In accordance with the present invention, the electrode 172 receiving the relatively lower potential has an aperture pattern so configured so as to create symmetrical field components for the outer beams 174, 178 which have the effect of bending or refracting the outer beams 174, 178 toward a distant common point.

As explained in more detail and claimed in our copending application, Ser. No. 579,128, a dynamic voltage may be applied to one or both of the electrodes 170, 172 to cause the beam convergence angle to vary as a function of beam deflection.

In accordance with the present invention, the asymmetrical field component acting upon the outer beams 174, 178 is produced by enlarging the apertures 186, 190 in a direction toward the center aperture 188. The opening enlargements are shown as taking the form of rounded protuberances 192, 194, respectively, in the profile of the apertures 186, 190. Many other opening distortion geometries may be utilized in accordance with the present invention, dependent upon the nature and degree of unbalancing of the fields on the outer beams which is desired.

Figure 24:
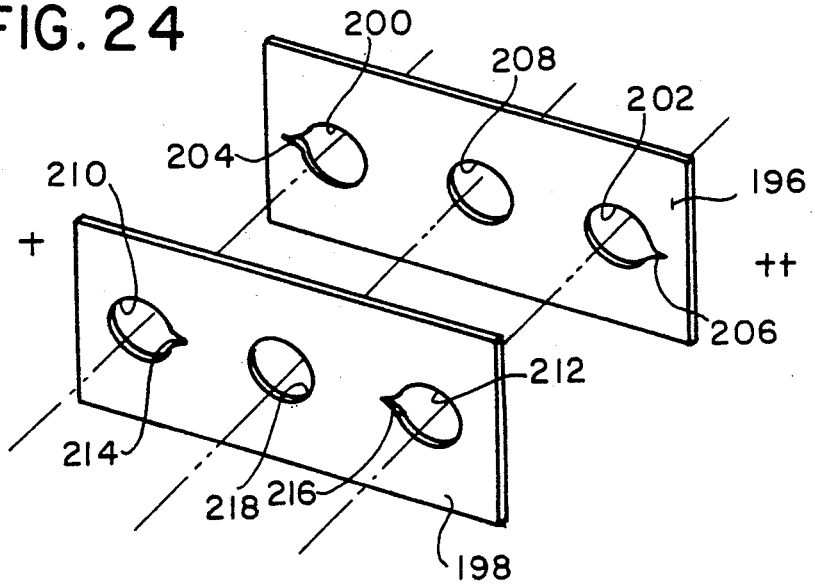
FIG. 24 is a simplified schematic diagram of yet another embodiment of the present invention wherein an asymmetric field component is formed by distorting the outer beam apertures in a pair of adjacent focusing electrodes maintained at different voltages.

FIG. 24 illustrates yet another embodiment of the present invention wherein the asymmetrical field component is formed by distorting the openings for the outer beams in both electrode 196 receiving a relatively higher voltage and electrode 198 receiving a relatively lower voltage. Specifically, the electrode 196 has outer beam passing openings 200, 202 which have opening enlargements 204, 206 extending outwardly away from the center beam opening 208. The electrode 198 adapted to receive the lower potential has outer beam apertures 210 and 212 having opening enlargements 214, 216 which extend inwardly toward the center beam opening 218. The FIG. 24 embodiment illustrates that opening enlargements may be employed in both the high voltage and lower voltage electrodes as well as in either alone and that these opening enlargements may assume various forms.

While particular embodiments of the present invention have been shown and described, it will be obvious to those skilled in the art that changes and modifications may be made without departing from the invention in its broader aspects. For example, while the present invention has been described as applying a dynamic voltage to first and third electrodes and a fixed voltage to a second electrode spaced therebetween, this invention also contemplates applying a dynamic voltage to the second electrode while maintaining the spaced first and third electrodes at a fixed voltage. Therefore, the aim in the appended claims is to cover all such changes and modifications as fall within the true spirit and scope of the invention. The matter set forth in the foregoing description and accompanying drawings is offered by way of illustration only and not as a limitation. The actual scope of the invention is intended to be defined in the following claims when viewed in their proper perspective based on the prior art.

We claim:

1. A three-beam in-line electron gun for a color cathode ray tube, comprising:

means for generating three beams of electrons aligned in a common plane—a center beam and two outer beams; and beam bending means for producing asymmetrical fields in the paths of said outer beams for diverting said outer beams from respective straight line paths toward a common point of convergence, comprising at least two facing electrodes, a first electrode being adapted to receive a relatively higher excitation potential and a second electrode a relatively lower excitation potential, said second electrode having a center opening and two outer openings arranged in line along an electrode horizontal axis orthogonal to the gun axis, said outer openings having inwardly extending enlargements which are symmetrical about said electrode horizontal axis and a vertical axis through the center opening, but asymmetrical about respective vertical axes through the outer openings to thereby produce said asymmetrical fields for said outer beams.

2. An electron gun defined by claim 1 wherein both of said electrodes have outer beam openings having opening distortions in the form of opening enlargements, the opening enlargements in the second electrode extending inwardly towards said center opening, and the opening enlargements in the first electrode extending outwardly away from said center opening.

3. A three-beam in-line electron gun for a color cathode ray tube, comprising:

means for generating three beams of electrons aligned in a common plane—a center beam and two outer beams;

beam bending means for producing asymmetrical fields in the paths of said outer beams for diverting said outer beams from respective straight line paths toward a common point of convergence, comprising at least two facing electrodes, a first electrode being adapted to receive a relatively higher excitation potential and a second electrode a relatively lower excitation potential, said second electrode having a center opening and two outer openings arranged in line along an electrode horizontal axis orthogonal to the gun axis, said outer openings having inwardly extending enlargements which are symmetrical about said electrode horizontal axis and a vertical axis through the center opening, but asymmetrical about respective vertical axes through the outer openings to thereby produce said asymmetrical fields for said outer beams; and means for modulating the strength of said asymmetric field components acting on said outer beams as a function of beam deflection angle.

4. An electron gun including at least two facing apertured electrodes, one adapted to receive a relatively higher excitation potential and the other a relatively lower excitation potential, said electrodes being constructed and arranged such that a quadrupolar field component is created therebetween when different excitation potentials are applied to said facing electrodes, said electrodes including means for unbalancing the quadrupolar field component such as to cause an electron beam to be diverted from a straight line path as a function of the difference between said different excitation potentials.

5. The electron gun defined by claim 4 wherein said means for unbalancing comprises a distortion in the profile of one or both of associated coaxial beam-passing openings in said facing electrodes.

6. The electron gun defined by claim 5 wherein said profile distortion is such that the distorted opening is symmetrical about a first electrode axis, but asymmetrical about an orthogonal second electrode axis.

7. A three-beam in-line color CRT including quadrupole lens means for influencing said electron beams, comprising at least two facing apertured electrodes, one adapted to receive a relatively higher excitation potential and the other a relatively lower excitation potential, said electrodes having apertures configured such that quadrupolar field components are created therebetween for said beams when different excitation potentials are applied to said facing electrodes, the electrode aperture configuration being such as to unbalance the outer beam quadrupolar field components to cause said outer beams to converge or diverge from a straight line path as a function of the difference between said different excitation potentials.

8. The electron gun defined by claim 7 wherein said means for unbalancing comprises a distortion in the profile of one or both of associated coaxial beam-passing openings in said facing electrodes.

9. The electron gun defined by claim 8 wherein said profile distortion is such that the distorted opening is symmetrical about a first electrode axis, but asymmetrical about an orthogonal second electrode axis.

10. A three-beam in-line color CRT electron gun including an electron lens for influencing said electron beams, comprising at least two facing electrodes, a first electrode being adapted to receive a relatively higher excitation potential and a second electrode a relatively lower excitation potential, at least one of said electrodes having a center opening and two outer openings arranged in line along an electrode axis orthogonal to the gun axis, said outer apertures having inwardly extending enlargements which are symmetrical about said electrode axis and a vertical axis through the center opening, but asymmetrical about respective vertical axes through the outer openings.

11. A three-beam in-line color CRT gun having an axis and including a quadrupole lens for influencing said electron beams, comprising:

at least two facing electrodes, one adapted to receive a relatively higher excitation potential and the other a relatively lower excitation potential, said electrodes including respective openings each having a profile which interacts with an opening in a facing electrode such as to create a quadrupolar field therebetween when different excitation potentials are applied to said facing electrodes, a first one of said electrodes having a center opening and two outer openings arranged in a line along an electrode axis extending orthogonal to the gun axis, said outer openings having profile distortions which are symmetrical about said electrode axis and a vertical axis through the center aperture, but asymmetrical about respective vertical axes through the outer openings to create asymmetrical outer beam fields.

12. The electron gun defined by claim 11 wherein said dynamic quadrupolar lens is of the unipotential type comprising three electrodes, and wherein said first one of said electrodes is the center electrode.

13. The apparatus by claim 11 wherein said one of said electrodes is said first electrode adapted to receive said higher potential and its outer beam openings have said profile distortions in the form of an opening enlargement extending outwardly away from said center opening.

14. The apparatus of claim 11 wherein said one of said electrodes is said second electrode adapted to receive said lower potential and its outer beam apertures have said profile distortions in the form of an opening enlargement extending inwardly toward said center aperture.

15. In a three-beam in-line electron gun system for a color cathode ray tube having a screen and a self-converging yoke which imparts an undesirable astigmatism to the beams in off-center regions of the screen, apparatus comprising:

an electron beam source for developing three electron beams;

focusing means for focusing said three electron beams at the screen of the tube, said focusing means being so constructed and arranged that changes in focusing field strength undesirably alter beam convergence;

correcting lens means located within or coupled to said focusing means for developing an astigmatic field component in the path of each of said beams when said lens means is appropriately excited; and means for modulating the strength of said astigmatic field component as a function of beam deflection angle to at least partially compensate for said yoke-induced astigmatism in said off-center regions of the screen, said modulating of said astigmatic field component also modulating said focusing field strength and undesirably creating errors in the convergence of said beams, said correcting lens means including electrode means having a beam passing opening pattern shaped to create asymmetrical outer beam fields effective to at least partially compensate for said deflection-related beam convergence errors.

16. The apparatus defined by claim 15 wherein said correcting lens means comprises a dynamic quadrupole lens of the unipotential type comprising first, center and third electrodes.

17. The apparatus defined by claim 16 wherein said center electrode is adapted to receive a lower potential than said first and third electrodes, and wherein said center electrode has a center opening and two outer openings arranged in a line along an electrode axis orthogonal to the gun axis, said outer openings having profile distortions which are symmetrical about said electrode axis and a vertical axis through the center opening, but asymmetrical about respective vertical axes through the outer openings.

18. The apparatus defined by claim 17 wherein said aperture distortions each take the form of a notch extending inwardly toward said center aperture.

19. An aperture as defined by claim 18 wherein said first and third electrodes are adapted to receive a common excitation potential higher than that received by said center electrode, and wherein each of said first and third electrodes have a center opening and two outer openings arranged in a line along the electrode axis orthogonal to the gun axis, said outer openings having profile distortions which are symmetrical about said electrode axis and a vertical axis through the center opening, but asymmetrical about respective vertical axes through the outer openings.

20. The apparatus defined by claim 19 wherein said distortions in said outer openings of said first and third electrodes each take the form of an outwardly extending notch.

21. For use in a color cathode ray tube system having a color tube with a cathodoluminescent screen, a system adapted for use with a deflection yoke having an asymmetrical yoke field for self-converging said beams which undesirably astigmatizes said beams in off-center regions of the screen, said system comprising:

an in-line electron gun for developing three electron beams for exciting said screen, said gun including, for each of said beams, means including cathode means for developing said beam, focus lens means including focus electrode means for receiving said electron beam and forming a focused electron beam spot at the screen of the tube, said focus lens means having a plurality of electrode means spaced along a lens axis;

beam correcting means incorporated in said focus electrode means for developing in the path of said beam when said beam correcting means is appropriately excited, an astigmatic field component; and system signal generating means for developing a signal having amplitude variations correlated with a scan of the beams across the screen and means for applying said signal to said beam correcting means to cause, as a function of beam deflection angle, the strength of said astigmatic field component to vary to produce a dynamic astigmatism-correction effect to at least partially compensate for the beam-astigmatizing effect of said yoke, said focus lens means being so constructed and arranged that operation of said beam correcting means causes undesired deflection-related misconvergence of said beams as they are swept;

said beam correcting means including misconvergence compensation means for at least partially compensating for said undesired beam misconvergence, comprising at least two facing electrodes, a first electrode being adapted to receive a relatively higher excitation potential and a second electrode a relatively lower excitation potential, at least one of said electrodes having a center opening and two outer openings arranged in line along an electrode axis orthogonal to the gun axis, said outer openings having profile distortions which are symmetrical about said electrode axis and a vertical axis through the center opening, but asymmetrical about respective vertical axes through the outer openings.

22. The electron gun defined by claim 21 wherein said misconvergence compensation means comprises an asymmetric dynamic quadrupolar lens of the unipotential type comprising first, center and third electrodes, the center electrode being adapted to receive a relatively lower excitation potential than the first and third electrodes, the center electrode having its outer apertures with said profile distortions.

23. The apparatus defined by claim 22 wherein said center electrode outer beam openings have said opening distortion in the form of an opening enlargement extending inwardly toward said center aperture.

24. For use in a color cathode ray tube system having a color tube with a cathodoluminescent screen, a system adapted for use with a deflection yoke having an asymmetrical yoke field for self-converging said beams which undesirably astigmatizes said beams in off-center regions of the screen, said system comprising:

an in-line electron gun for developing three electron beams for exciting said screen, said gun including for each of said beams, means including cathode means for developing said beam, focus lens means including focus electrode means for receiving said electron beam and forming a focused electron beam spot at the screen of the tube, said focus lens means having a plurality of electrode means spaced along a lens axis;

dynamic quadrupole beam correcting means incorporated in said focus electrode means for developing in the path of said beam when appropriately excited an astigmatic field component, comprising three spaced electrodes, a center electrode adapted to receive a relatively lower excitation potential and two outer electrodes adapted to receive relatively higher excitation potentials, said electrodes having openings effective when said electrodes are excited to create a quadrupolar field therebetween;

system signal generating means for developing a signal having amplitude variations correlated with a scan of the beam across the screen and means for applying said signal to said gun to simultaneously cause, as a function of beam deflection angle, the strength of the focusing field and the strength of said astigmatic field component to vary to produce a dynamic astigmatism-correction effect to at least partially compensate for the beam-astigmatizing effect of said yoke, said focus lens means being so constructed and arranged such that operation of said beam correcting means causes undesired deflection-related misconvergence of said beams as they are swept;

said beam correcting means including means for at least partially compensating for said undesired beam misconvergence, comprising at least two facing electrodes, a first electrode being adapted to receive a relatively higher excitation potential and a second electrode a relatively lower excitation potential, at least one of said electrodes having a center opening and two outer openings arranged in line along an electrode axis orthogonal to the gun axis, said outer openings having profile distortions which are symmetrical about said electrode axis and a vertical axis through the center opening, but asymmetrical about respective vertical axes through the outer openings.

25. For use in a color cathode ray tube (CRT) wherein first, second and third inline electron beams are directed onto a phosphorescing screen in the CRT, with said second beam disposed intermediate said first and third beams, an electron gun comprising:

cathode means for generating electrons;

crossover means for receiving electrons from said cathode means and for forming a beam crossover;

first focusing means driven by a dynamic voltage for focusing the inline electron beams on the phosphorescing screen, wherein a misconvergence is present among the electron beams on the phosphorescing screen; and second focusing means disposed adjacent to said first focusing means for displacing the first and third electron beams horizontally toward the second beam for reducing said misconvergence and bringing said electron beams into convergence on the phosphorescing screen, wherein said second focusing means includes first and third outer apertures and a second middle aperture through which respective ones of the electron beams are directed, and wherein said first and third outer apertures each include an inwardly directed notch.

26. The electron gun of claim 25 wherein said first focusing means includes first and third spaced electrodes and said second focusing means includes a second electrode disposed intermediate said first and third electrodes.

27. The electrode of claim 26 wherein said first and third electrodes each include respective aligned, elongated apertures through which the three inline electron beams are directed.

28. The electron gun of claim 27 wherein the apertures in said first and third electrodes are generally horizontal and the first, second and third apertures in said second electrode are generally keyhole-shaped.

29. The electron gun of claim 28 wherein said first, second and third keyhole-shaped apertures in said second electrode are aligned generally vertical.

30. The electron gun of claim 29 wherein each of the keyhole-shaped apertures in said second electrode includes an enlarged center portion through which a respective electron beam is directed and further includes a cut-out notch extending inwardly toward the second aperture in said second electrode.

31. The electron gun of claim 30 wherein said first and third electrodes are a G3 lower and a G3 upper electrode, respectively, and said second electrode is a G3 middle electrode.

32. The electron gun of claim 31 wherein said second electrode is maintained at a fixed voltage.

33. The electron gun of claim 25 wherein said second focusing means includes electrostatic asymmetrical quadrupole field means for exerting a horizontal electrostatic force on the first and third outer electron beams.

34. The electron gun of claim 33 wherein said electrostatic quadrupole field means comprises first and third dynamically charged, spaced electrodes and a second statically charged electrode disposed therebetween.

35. The electron gun of claim 34 wherein said first and third dynamically charged electrodes each include a respective, elongated, horizontal slot through which the three electron beams are directed in a spaced manner.

36. The electron gun of claim 35 wherein each of said elongated slots includes three spaced enlarged portions, through each of which a respective one of the electron beams is directed.

37. The electron gun of claim 35 wherein said second electrode includes first, second and third parallel, generally vertically aligned apertures, through each of which a respective one of the electron beams is directed, and wherein said second aperture is disposed intermediate said first and third apertures.

38. The electron gun of claim 37 wherein each of said first and third apertures includes a cut-out notch extending inwardly toward said second slot in said second electrode.

39. The electron gun of claim 38 wherein each of said apertures is in the general form of a keyhole having an enlarged generally circular center portion, and wherein the cut-out notches extend inwardly from the center circular portion of the first and third slots.

40. The electron gun of claim 25 wherein each of said apertures is generally circular.

41. The electron gun of claim 34 further comprising a first fixed voltage source for providing a fixed voltage $VF_1$ to said second statically charged electrode and a second variable voltage source for providing a variable voltage $VF_2$ to said first and third dynamically charged electrodes.

42. The electron gun of claim 41 wherein said variable voltage $VF_2$ varies periodically with time and assumes values greater and less than the fixed voltage $VF_1$ for alternately changing the relative polarity of said dynamically and statically charged electrodes.

43. The electron gun of claim 42 wherein said variable voltage $VF_2$ is greater than said fixed voltage $VF_1$ when the electron beams are positioned toward a lateral edge of the CRT screen, and wherein said variable voltage $VF_2$ is less than said fixed voltage $VF_1$ when the electron beams are positioned in the area of the center of the CRT screen.

44. The electron gun of claim 41 wherein said second variable voltage $VF_2$ varies periodically between values greater than and equal to said fixed voltage $VF_1$.

45. The electron gun of claim 44 wherein said first variable voltage $VF_2$ is greater than said second fixed voltage $VF_1$ when the electron beams are positioned adjacent to a lateral edge of the CRT screen, and wherein said first variable voltage $VF_2$ equals said second fixed voltage $VF_1$ when the electron beams are positioned adjacent to the center of the CRT screen.

46. The electron gun of claim 39 wherein said first and third dynamically charged electrodes each includes a respective elongated slot having a longitudinal axis generally aligned with the inline electron beams, and wherein the electron beams are directed through each of said elongated slots.

47. The electron gun of claim 46 wherein each of said elongated slots includes a plurality of enlarged portions arranged in a spaced manner along the length thereof, and wherein each enlarged portion of a slot is aligned with and passes a respective electron beam.

48. The electron gun of claim 33 wherein said electrostatic quadrupole field means is disposed between said beam crossover and the CRT screen.

49. The electron gun of claim 33 wherein said electrostatic quadrupole field means is disposed between said cathode means and said beam crossover.

50. For use in focusing a plurality of electron beams on a phosphorescing screen of a color cathode ray tube (CRT), wherein said electron beams are aligned in an inline array and are focused on said phosphorescing screen by a dynamic focus voltage which causes misconvergence of said electron beams, an electron gun comprising:

an electron beam source for generating and directing a plurality of electron beams in a common direction;

a first dynamically charged electrode having at least one aperture therein through which the electron beams are directed;

a second statically charged electrode having a plurality of apertures therein through each of which a respective one of the electron beams is directed, wherein said second electrode includes first and third outer apertures and a second aperture intermediate said first and third apertures, and wherein said first and third apertures include respective notched portions extending inward toward said second aperture for moving said first and third electron beams in a generally horizontal direction and eliminating misconvergence between the electron beams; and a third dynamically charged electrode having at least one aperture therein through which the electron beams are directed, wherein said second electrode is disposed intermediate said first and third electrodes.

51. In an electron gun for accelerating and focusing a plurality of inline electron beams on a cathode ray tube (CRT) screen and including a focusing electrode, the improvement comprising:

a first dynamically charged electrode incorporated in a first portion of said focusing electrode and having at least one elongated aperture for passing one or more of the electron beams;

a third dynamically charged electrode incorporated in a second portion of said focusing electrode and having at least one elongated aperture for passing one or more of the electron beams, wherein said first and third electrodes are arranged in spaced relation along the electron beams so as to divide the focusing electrode into first and second focusing electrode portions; and a second statically charged electrode disposed along the electron beams between said first and third electrodes so as to form first and second electrostatic quadrupole fields respectively therewith, wherein said second electrode includes a plurality of spaced elongated apertures each adapted for passing a respective one of the electron beams and wherein the apertures in said first and third electrodes are aligned generally transverse to the apertures in said second electrode, and wherein a pair of outer apertures in said second electrode each include a respective inner cut-out portion for horizontally deflecting a pair of outer electron beams toward a center electron beam and causing said electron beams to converge on a phosphorescing screen of the CRT.

52. For use in a color cathode ray tube system having a color tube with a cathodoluminescent screen, the system comprising:

an inline electron gun for developing first and third outer electron beams and a second center electron beam for exciting said screen, said gun including, for each of said beams, means including cathode means for developing said beam, focus lens means for receiving said electron beam and forming a focused electron beam spot at the screen of the tube, said focus lens means having a plurality of electrode means spaced along a lens axis including focus electrode means;

yoke means for deflecting said electron beams, said yoke means having an asymmetrical field for self-converging said beams which undesirably astigmatizes said beams in off-center regions of the screen;

beam correcting means incorporated in said focus electrode means for developing in the path of said beam when appropriately excited a first astigmatic accelerating field component and a second astigmatic decelerating field component;

system signal generating means for developing a signal having amplitude variations correlated with a scan of the beam across the screen and means for applying said signal to said beam correcting means to cause, as a function of beam deflection angle, the strength of said first and second astigmatic field components to vary to produce a dynamic astigmatism-correction effect to at least partially compensate for the beam-astigmatizing effect of said yoke; and convergence correcting means incorporated in said focus electrode means for horizontally deflecting said two outer electron beams toward said second center electron beam on the cathodoluminescent screen in correcting for misconvergence of the electron beams, said convergence correcting means including an electrode having first and second offset keyhole-shaped slots through which said first and third outer electron beams are directed for exerting an asymmetrical electrostatic field on said first and third outer electron beams.

53. For use in a color cathode ray tube system having a color tube with a phosphor screen, the system comprising:

a three-beam, in-line gun for exciting said screen, said gun including;

cathode means and focus lens means for developing a center beam and two outer beams and for forming three focused electron beam spots at the screen of the tube, and electrostatic quadrupole-developing means configured and arranged to develop a horizontally unbalanced quadrupole field in the path of each of said outer beams when appropriately excited; and system signal generating means for developing a signal having amplitude variations correlated with the scan of the beams across the screen and for applying said signal to said electrostatic quadrupole-developing means to cause said beams to converge and diverge as a function of the strength of said signal, said quadrupole-developing means including electrode means having outer beam apertures shaped to create field-strength-dependent asymmetrical outer beam fields whose strength varies as said signal varies.

54. The system defined by claim 53 wherein said quadrupole-developing means comprises at lest two facing electrodes, one adapted to receive a relatively higher excitation potential and the other a relatively lower excitation potential, the outer apertures of said electrode each having a profile which interacts with an aperture in a facing second electrode having an orthogonally different profile such as to create a quadrupolar field therebetween when different excitation potentials are applied to said first and second electrodes, at least a first one of said electrodes having a center aperture and two outer apertures arranged in a line along an electrode, an axis extending orthogonal to the gun axis, said outer apertures of said first electrode having profile distortions which are symmetrical about said electrode axis and a vertical axis through the center aperture, but asymmetrical about respective vertical axes through the outer apertures to create asymmetrical outer beam fields.

* * * * *